US005237909A

United States Patent [19]

Pirhadi

[11] Patent Number: 5,237,909

[45] Date of Patent: Aug. 24, 1993

[54] FASTENING DEVICE FOR ACTUATING CYLINDERS

[75] Inventor: Ebrahim Pirhadi, Enskede, Sweden

[73] Assignee: AB Mecman, Stockholm, Sweden

[21] Appl. No.: 842,115

[22] PCT Filed: Sep. 26, 1990

[86] PCT No.: PCT/SE90/00617

§ 371 Date: Mar. 23, 1992

§ 102(e) Date: Mar. 23, 1992

[87] PCT Pub. No.: WO91/05187

PCT Pub. Date: Apr. 18, 1991

[30] Foreign Application Priority Data

Oct. 4, 1989 [SE] Sweden ..... 8903266

[51] Int. Cl.[5] ..... F01B 29/00

[52] U.S. Cl. ..... 92/161; 92/128; 248/316.5; 248/74.4

[58] Field of Search ..... 92/161, 146, 88; 248/316.5, 74.1, 74.4, 74.5, 68.1

[56] References Cited

U.S. PATENT DOCUMENTS 1,049,204 12/1912 Bushnell ..... 92/161
4,700,616 10/1987 Stoll et al. ..... 92/161
4,802,646 2/1989 Cattani ..... 248/316.5

FOREIGN PATENT DOCUMENTS 1246413 8/1967 Fed. Rep. of Germany .
460918 12/1989 Sweden .

OTHER PUBLICATIONS

International Search Report PCT/SE90/00617, mailed Dec. 28, 1990.

PCT International Preliminary Examination Report, PCT/SE90/00617, completed Dec. 1991.

*Primary Examiner*—Thomas E. Denion

*Attorney, Agent, or Firm*—Townsend and Townsend Khourie and Crew

[57] ABSTRACT

A fastening device for actuating cylinders with longitudinal stringers extending axially along a cylinder tube. A fastening yoke, e.g. comprising two halves is clampable with the aid of at least one clamping screw for fixing it in a desired axial position along the cylinder tube. In accordance with the invention the opposing clamping portions of the fastening yoke act on two intermediate clamping blocks which are thus pivoted in opposite directions, so that clamping is achieved exclusively against the inner and outer side portions and whereby internal deformation of the cylinder tube is prevented.

12 Claims, 2 Drawing Sheets

FASTENING DEVICE FOR ACTUATING CYLINDERS

BACKGROUND OF THE INVENTION

The invention relates to a fastening device for actuating cylinders, provided with at least two stringers situated at a maximum of 90° from each other in a circumferential direction. The fastening device includes a fastening yoke, circumferentially surrounding the cylinder tube of the actuating cylinder and having at least two opposing clamping portions, which can be pulled together with the aid of a clamping screw for clamping the fastening yoke in a desired axial position along the cylinder tube.

The fastening device is intended to be used for actuating cylinders provided with stringers of the form of tie rods extending externally to the cylinder tube and keeping together the end walls of the cylinder tube, as well as for actuating cylinders provided with stringers comprising longitudinal beads formed integrally with the cylinder tube.

A problem occuring in the use of fastening yokes which are clamped circumferentially round the cylinder tube is that the large clamping force required to securely maintain the yoke in the set axial position along the cylinder tube causes deformation of the cross-sectional configuration of the cylinder tube. Such a deformation may in turn cause the piston to stick or even get locked in the cylinder bore.

SUMMARY OF THE INVENTION

The object of the invention is to enable secure fastening of the fastening yoke without accompanying deformation of the cylinder tube, particularly the internal cylindrical surface of the tube. Further objects are to achieve a simple and easily handled device while avoiding engagement with sharp edges which can give permanent deformations in the mating surfaces in question. Accordingly, the device shall allow repeated fastening in desired axial positions, i.e. continuously along the entire cylinder tube and not only in certain, specific positions.

These objects are achieved by a fastening device including a fastening yoke having two opposing clamping portions. Each opposing clamping portion has an outer side engaging portion configured to engage one of the outer sides. The clamping portions are clamped together, preferably with screws. A pair of clamping blocks is positioned between the pair of opposing clamping portions with each clamping block engaging one of the opposing clamping portions at outer portions of the clamping blocks. The pair of clamping blocks are pivotally mounted about engagement regions disposed radially inward with respect to the outer portions. Each clamping block also includes an inner portion configured to engage the inner side of one of the stringers so that when the opposing clamping portions are clamped together, the outer side engaging portions engage the outer sides of the stringers and the inner portions engage the inner sides of the stringers. This fastens the device to the actuating cylinder with a clamping force on the stringers and minimizes deformation of the actuating cylinder.

The fastening yoke is clamped exclusively against the stringers, and therefore, does not exert any notable clamping force on the cylinder tube. The clamping forces are instead applied to the "outer" and "inner" side portions of the stringers. The terms "outer" and "inner" are here used in relation to the dimension in the circumferential direction in the region for an associated clamping screw, e.g. approximately to the linear extension of the clamping screw between the opposing clamping portions of the fastening yoke. In the case where the stringers are beads integral with the cylinder tube, the clamping forces are applied substantially in the circumferential direction from opposing directions towards the respective bead, and thus the clamping forces substantially counteract each other. If, as disclosed in claim 7, the opposing clamping surfaces are mutually parallel, radial force result either.

An essential aspect of the invention is that the clamping screw can be tightened with a large force without both associated stringers (i.g. tie rods or longitudinal beads) being subjected to a corresponding force pulling them together which would deform the cylinder tube. This force is instead taken up by the clamping blocks inserted between the clamping portions of the fastening yoke, these block are stressed in the opposite direction to the inner side portion of the respective stringer. With the fastening device in accordance with the invention, the clamping forces can therefore be applied exclusively to the stringers, without the cylinder tube itself and its internal cylindrical surface being subjected to any substantial force as a result of tightening the clamping screw.

As disclosed in claim 2, the clamping blocks are suitably pivotably mounted for pivoting in opposing directions. The movement towards each other of the clamping portions can thus be easily converted to a parting movement with accompanying counter directed clamping force action on both the stringers.

The invention will now be described in greater detail with reference to the accompanying drawings, which illustrate the preferred embodiments.

DESCRIPTION OF THE PREFERRED EMBODIMENTS

Figure 1:
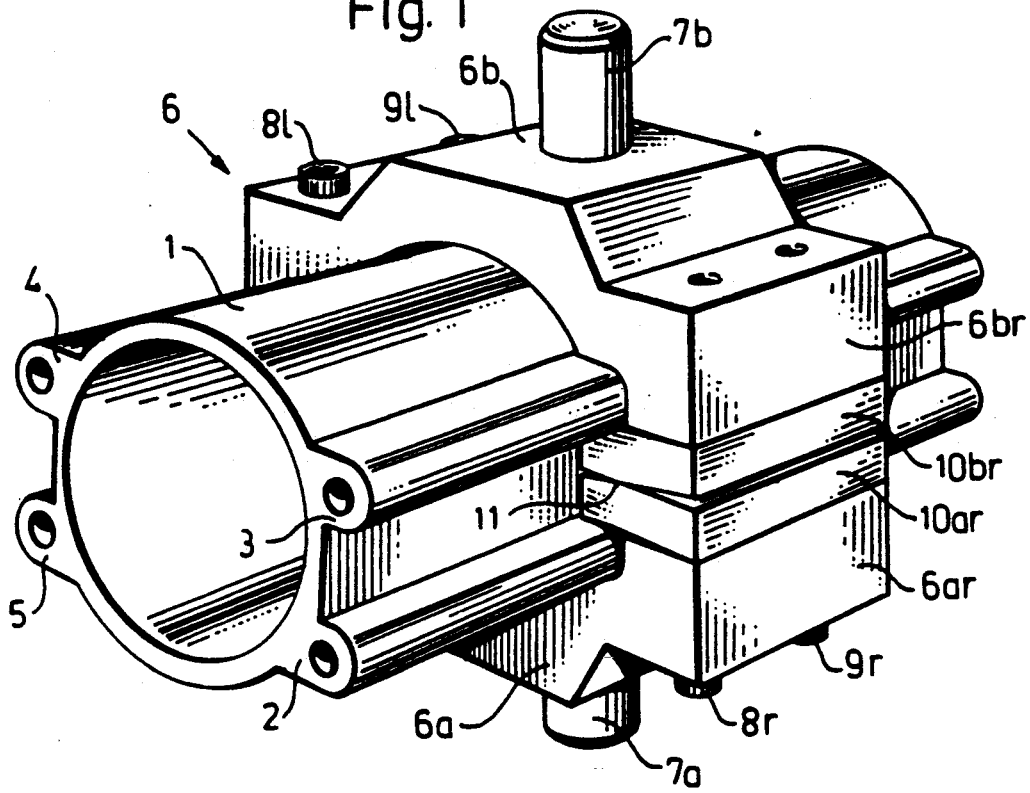
FIG. 1 is a perspective view of an actuating cylinder (associated end walls, pressurized medium hoses and piston are not shown) with a fastening yoke mounted on the cylinder tube.
Figure 2:
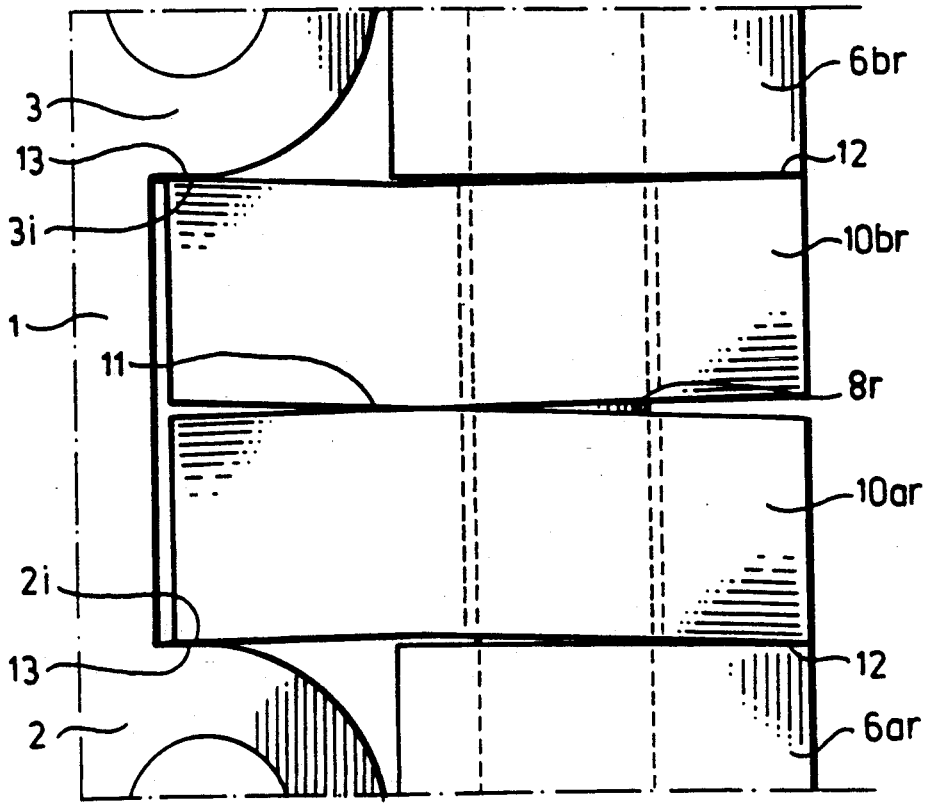
FIG. 2 is a larger scale detail of FIG. 1 illustrates a pair of clamping blocks inserted between the opposing clamping portions of the fastening yoke.
Figure 3:
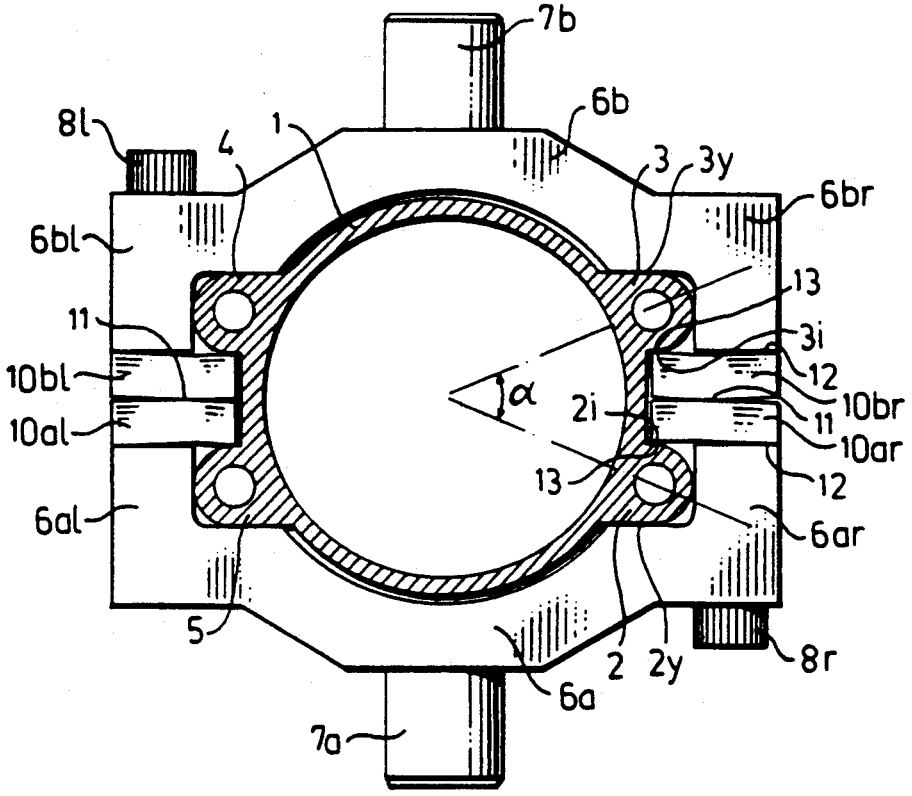
FIG. 3 is a cross-section through the cylinder tube and fastening yoke according to FIG. 1.

In the embodiment according to FIGS. 1-3, the actuating cylinder tube 1 is provided with beads 2,3,4,5 formed integral therewith and extending mutally parallel axially along the cylinder tube. The beads are arranged in pairs such that those in a pair, e.g. beads 2,3 and beads 4,5 are at an angular distance $\alpha$ from each other in a circumferential direction, where $\alpha$ is a maximum of 90°, and in the illustrated case about 45°. Each bead has an axial, through bore, which can be utilized at the ends of the cylinder tubes for fixing the end walls, e.g. with the aid of fastening screws. Alternatively, tie rods can be inserted in these holes, provided that the rods can be prestressed with sufficient tensile force to take up the separating forces on the end walls caused by the pressurized medium.

A fastening yoke 6 comprising two halves 6*a*,6*b* surrounds the cylinder tube 1 without touching its outside, except in the area of the beads 2–5 (see FIG. 3), and can be clamped in any desirable axial position along the cylinder tube by clamping action exerted exclusively against the side portion of the beads. In the illustrated example, the halves 6*a*,6*b* each has a stub journal 7*a*, 7*b* for mounting the actuating cylinder so that it is fixed at the journals, possibly for pivoting about these journals.

The halves 6*a*,6*b* are clamped with the aid of two pairs of clamping screws 8*r*,9*r* and 8*l*,9*l*. One end of the halves is pulled together by the first pair of screws 8*r*,9*r* (to the right in FIGS. 1–3), these forming clamping portions 6*ar*,6*br*, while the other end of the halves (see FIG. 3) forming clamping portions 6*al*,6*bl*are pulled together with the aid of the second pair of clamping screws 8*l*,9*l* (to the left in FIGS. 1–3). Pairs of clamping blocks 10*ar*,10*br* and 10*al*,10*bl* are inserted between opposing clamping portions 6*ar*,6*br* and 6*al*,6*bl*, respectively, the respective clamping screw extending freely through registering holes in the respective clamping portion 6*ar* and 6*bl* (where the screw head engages against the outside) and in both clamping blocks in the respective pair and being in threaded engagement with an internal thread in the other, opposing clamping portion 6*br* or 6*al*, respectively.

In the embodiment according to FIGS. 1–3, both clamping blocks in a pair (10*ar*, 10*br* or 10*al*, 10*bl*) engage each other in an engagement region 11 situated radially inside the associated clamping screw. The engagement region 11 forms pivotal center for the clamping blocks when the screws are tightened and the respective clamping portion (see particularly FIG. 2 with the clamping portion 6*ar*, 6*br* and the clamping blocks 10*ar*, 10*br*) is tightened against the radially outer corner edge 12 on the outside of the respective clamping block. The clamping blocks in a pair, e.g. 10*ar*, 10*br* are thus caused to pivot in opposite directions with mutal engagement in the region 11 so that the radially inmost corner edge portions 13 are urged under clamping action towards the inner side portions are 2*i*, 3*i* of the respective bead 2,3. The respective clamping portion of the halves 6*a*, 6*b* simultaneously abut against the outer side portion 2*y*, 3*y* (see FIG. 3) of the respective bead 2,3. The opposite side portions 2*i*, 2*y*; 3*i*, 3*y* of the respective bead 2,3 form parallel engagement surfaces, the clamping forces thus completely counteracting each other with no further force resultant occuring, which could deform the cylinder tube 1. As will be seen, the fastening yoke halves 6*a*, 6*b* are dimensioned such that they do not touch the cylinder tube 1 except at the opposing side portions of the beads.

A condition for achieving this desired pivoting movement of the clamping blocks, and accompanying clamping action against the inner side portions of the beads is that the pivotal center (the engagement region 11) is located, in a radial direction, between the regions 12, 13, where the clamping blocks are urged against the clamping portions and the beads. Accordingly, the clamping blocks in a pair have on the one hand mutually opposing, convex surfaces formed for line or spot engagement in the region 11, suitably radially inside the associated clamping screw. On the other hand the clamping blocks have surfaces facing away from each other which are formed for engagement against the clamping portions (at 12) of the fastening yoke, radially outside the pivoting center, as well as surfaces for engaging against the inner side portions (at 13) of the beads radially inside the pivotal center.

For obtaining effective clamping action and good retaining force, the clamping blocks have their surfaces facing away from each other suitably formed for spot or line engagement both against the clamping portions (at 12) of the fastening yoke and the inner side portions (at 13) of the beads.

By "spot or line engagement" is intended here engagement in a limited surface area, which in practice can be a small surface area about a point or a relatively narrow surface area along a line.

To obtain the best possible friction, and thus the best possible fixation against axial displacement, it is further advantageous, either during manufacture or afterwards, to make the radially inward engagement surfaces (at 13) of the clamping portions and/or the clamping blocks rough, e.g. raw or knurled, so that a rough surface structure and effective friction action are obtained.

The geometry of the clamping blocks 10*ar*, 10*br* etc can be modified, although preferably in such a way that the above described pivotability about the pivotal center (between the engagement regions 12 and 13) is retained. Alternatively, it is possible to allow the clamping blocks to be translated in opposite directions into engagement with the inner side portions of the beads, e.g. with the intermediary of a mechanical transmission acting between the clamping portions and the clamping blocks. The illustrated embodiment is however extremely simple, cheap in manufacture and easy to assemble and use, the mutually opposing surfaces of the blocks having on either side (radially) of the engagement region 11 planar surface portions (see FIG. 2) and similarly planar surface portions on the surfaces facing away from each other which are parallel to the planar, mutually opposing surfaces.

Figure 4:
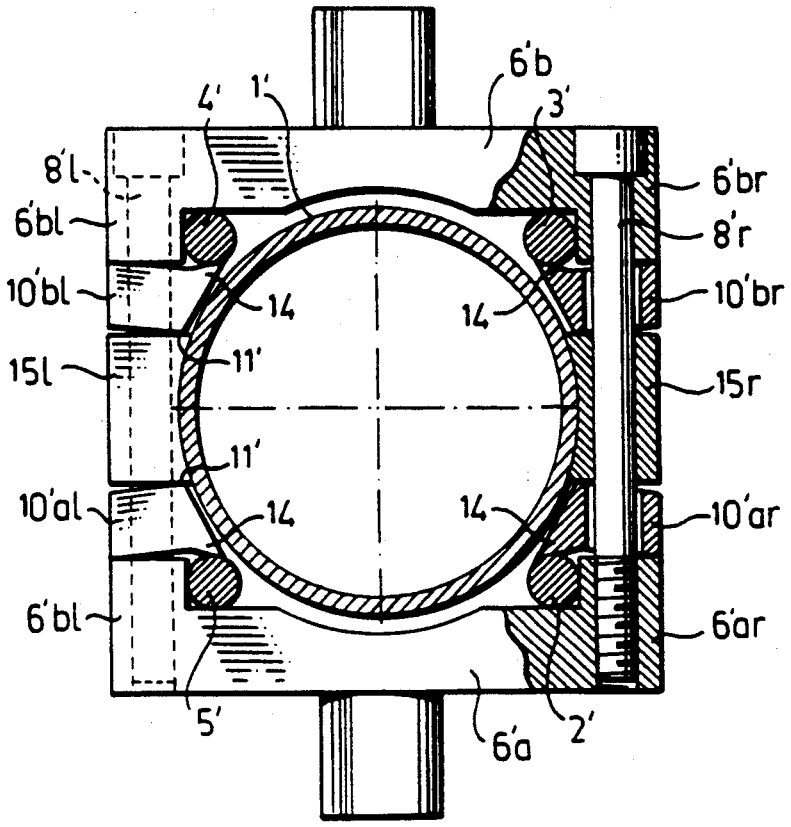
FIG. 4 is a cross-section of a modified embodiment of the fastening device for an actuating cylinder with tie rods.

As will be seen from FIG. 4, the fastening device in accordance with the invention can also be used in actuating cylinders having stringers in the form of tie rods 2',3',4',5', which keep the ends of the cylinder tube together and extend axially along the cylinder tube 1' spaced radially from the tube and (in the illustrated example) distributed at equal angular spacing (90°) in a circumferential direction.

In a way corresponding with the above described embodiment, two fastening yoke halves 6'*a* and 6'*b* are clamped with the aid of clamping screws 8'*a*,8'*l*. Pivotable clamping blocks 10'*ar*,10'*br*; 10'*al*,10'*bl* are acted on by the clamping portions 6'*ar*,6'*br*; 6'*al*,6'*bl* for engaging against the inner side portions of the tie rods while at the same time the clamping portions engage against the opposing outer side portions of the tie rods. In this case, the clamping blocks are provided with a radially inward, circumferentially extending engagement tongue 14, which is urged against a radially inward side portion of the associated tie rod (which has a circular cross-section in the illustrated example). The clamping portions 6'*ar*, etc are here urged against two radially outwardly situated parts of the outer side portions of the tie rods. Clamping action is thus exercised on three linear engagement surface portions, the clamping thus being very stable and secure without any force acting on the cylinder tube 1'. In the embodiment according to FIG. 4, the clamping blocks engage with their mutually opposing surfaces against an intermediate spacer 15*r*,15*l* in the respective pair, the pivotal center 11' in this case also lying radially between the outer engagement regions, where the respective clamping block engages against the clamping portion and the tie rod, respectively.

The clamping blocks 10'*ar*, etc and the spacers 15*r*,15*l* are kept in place by the clamping screws 8'*r*,8'*l* going through holes therein placed directly opposite each other.

It is also possible to allow outer clamping blocks (not shown) to act against the outer side portions of the stringers (the tie rods or beads). For the remainder, one skilled in the art can modify the fastening device in accordance with the invention within the scope of the following claims. For example, the clamping screws do not need to extend through holes in the clamping blocks, and the latter can be placed between two clamping screws.

I claim:

1. Fastening device for an actuating cylinder of the type including a cylinder tube and at least two stringers situated at a maximum of 90° from each other in a circumferential direction, comprising: a fastening yoke circumferentially surrounding the cylinder tube of the actuating cylinder and having at least two opposing clamping portions, which are pulled together with the aid of a clamping screw, means for clamping the fastening yoke in a desired axial position along the cylinder tube with the opposing clamping portions forced against an outer side portion of each stringer, a pair of clamping blocks pivotably mounted between the opposing clamping portions of the fastening yoke for pivoting in opposite directions, which clamping blocks in a pair have on the one hand surfaces facing towards each other formed for pivotal engagement at an engagement region located radially inside the associated clamping screw, and on the other hand surfaces facing away from each other formed for engagement against clamping portions of the fastening yoke radially outside said engagement region, and also for engagement against an opposing inner side portion of each stringer radially inside said engagement region, and in that the fastening yoke is dimensioned such that in the clamped position it extends round the cylinder tube without clamping action against the tube, whereby internal deformation of the cylinder tube is prevented.

2. Fastening device of claim 1, wherein the clamping blocks includes a through hole and the clamping means comprises a clamping screw positioned within the through hole, the through hole being sized to permit pivoting of the clamping blocks.

3. Fastening device of claim 1 wherein the engagement regions of both clamping blocks engage each other.

4. Fastening device of claim 1, wherein the clamping blocks include surfaces facing away from each other, said surfaces including the inner and outer portions.

5. Fastening device of claim 1, wherein the stringers comprise beads formed integral with the cylinder tube, and said inner and outer sides include substantially parallel engagement surfaces.

6. Fastening device of claim 1, wherein the stringers comprise tie rods which keep ends of the cylinder tube together, and the clamping blocks include circumferentially extending engagement tongues, the tongues being urged against a radially more inward side portion of the associated tie rod when the opposing clamping portions are clamped together with the clamping means.

7. Fastening device of claim 1, wherein the clamping blocks have a rough surface structure.

8. Fastening device of claim 1, wherein the fastening yoke comprises two halves, and the clamping means includes a first clamping screw positioned in a first through hole extending through a first end of the halves, the first clamping screw acting on a first pair of clamping blocks, and a second clamping screw positioned in a second through hole at a second end of the halves, the second clamping screw acting on a second pair of clamping blocks.

9. Fastening device of claim 1, wherein the stringers comprise beads formed integral with the cylinder tube, the beads having axial bores for fixation of end walls of the actuating cylinder with tie rods positioned within the bores.

10. A fastening device for actuating cylinders of the type including a cylinder tube and at least two stringers, each stringer having an outer side and an inner side opposite the outer side, the fastening device comprising:

a fastening yoke having two opposing clamping portions, said opposing clamping portion having outer side engaging portions configured to engage the outer sides;

means for clamping the two opposing clamping portions towards each other and the outer side engaging portions against the outer sides;

a pair of clamping blocks positioned between the opposing clamping portions, the clamping blocks including radially outer and inner portions, the clamping portions engaging the outer portions of the clamping blocks, the clamping blocks being pivotally mounted about engagement regions disposed between the inner and outer portions, the inner portions being configured to engage the inner side of the stringers so that when the opposing clamping portions are clamped together, the outer side engaging portions engage the outer sides of the stringers and the inner portions of the clamping blocks engage the inner sides of the stringers, thereby fastening the device to the actuating cylinder with a clamping force on the stringers to minimize deformation of the actuating cylinder.

11. Fastening device of claim 10 wherein the engagement regions of the clamping blocks engage opposite sides of an intermediate spacer.

12. Fastening device of claim 10 wherein the outer side engaging portions have a rough surface structure.

* * * * *